United States Patent [19]

Rousseau

[11] 4,433,365

[45] Feb. 21, 1984

[54] MINIATURE FLASHLIGHT

[76] Inventor: Jean P. Rousseau, 98, Rue de Miromesnil, 75008 Paris, France

[21] Appl. No.: 479,619

[22] Filed: Mar. 28, 1983

[30] Foreign Application Priority Data

Mar. 26, 1982 [FR] France ..... 82 05228

[51] Int. Cl.[3] ..... F21L 7/00

[52] U.S. Cl. ..... 362/189; 362/200; 362/201; 362/202; 362/203; 362/205; 362/206; 200/60

[58] Field of Search ..... 362/189, 200, 201, 202, 362/203, 205, 206; 200/60

[56] References Cited

U.S. PATENT DOCUMENTS

| | | | |
|---|---|---|---|
| 2,879,381 | 3/1959 | Coffey | 362/189 X |
| 4,122,510 | 10/1978 | Halliday | 362/189 |
| 4,210,953 | 7/1980 | Stone | 362/189 |
| 4,242,724 | 12/1980 | Stone | 362/189 X |
| 4,392,186 | 7/1983 | Cziment | 362/189 X |

FOREIGN PATENT DOCUMENTS

| | | |
|---|---|---|
| 1227982 | 6/1959 | France . |
| 1290742 | 6/1961 | France . |

*Primary Examiner*—Stephen J. Lechert, Jr.
*Attorney, Agent, or Firm*—Beveridge, DeGrandi & Kline

[57] ABSTRACT

Miniature flashlight consisting of a case (1) of moulded plastics material closed by a cover (2) that is at least partly metallic and containing a cell (18), an electric bulb (11–12) and a pressure spring (16), characterized in that the whole unit is flat in shape, comprising two facing walls formed respectively by the bottom wall (7) of the case and by at least a portion of the cover (2); in that the cell (18) consists of a flat cylindrical cell the casing of which is in contact with the center contact stud (19) of the bulb (12) and the opposite polarity contact (20) of which is oriented towards the cover (2); in that the bottom wall (7) of the case (1) comprises parts (9, 10) enabling the socket (11) of the bulb (12) to be housed and restrained; and in that at least one of the two facing walls (7 and 2) is flexible enough for compression of the unit between the fingers (25) to bring the socket (11) or the cell (18) contact (20) into contact with the conducting portion of the cover (2).

6 Claims, 6 Drawing Figures

MINIATURE FLASHLIGHT

The invention relates to flashlights of the type formed by a case in insulating material closed laterally by a cover which is metal at least in part.

A lamp of this type was described in French patent no. 2 377 083 in the applicant's name which enables a smallsize lamp to be made using for example the "stick" cell available commercially.

The purpose of the invention is to simplify this embodiment still further to make it suitable in particular for still greater miniaturization by using a flat cylindrical miniature cell of the button cell type.

The invention consists basically in making two longitudinal slits in the side of the case opposite the cover which bound between them a portion of wall which can be deflected by pressure from the outside, and in placing, on this wall and on the inner side, parts forming holder clips for the electric bulb in such a way that the external thrust on the flexible part brings the bulb's conducting socket into contact with the inner conducting part of the cover and that releasing this pressure moves this bulb away from this wall so opening the contact.

Other features of the invention, notably the case moulding and lamp mounting details will appear from the following description of an embodiment taken as an example and shown in the appended drawings, in which.

Figure 2:
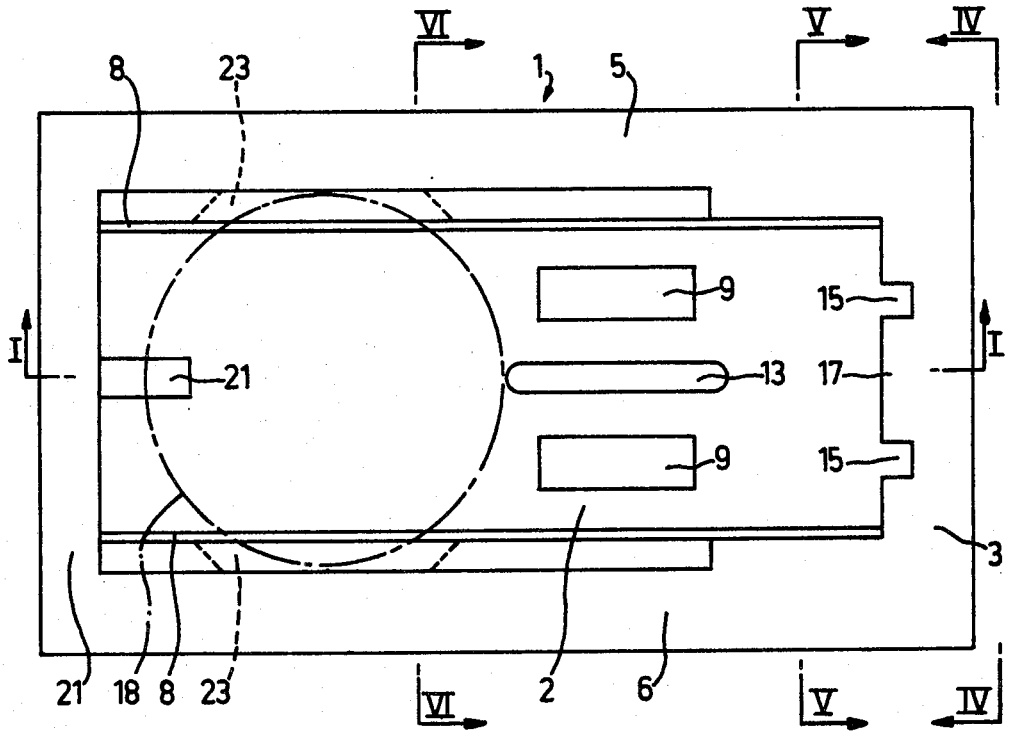
FIG. 2 is a top view of the case alone.
Figure 5:
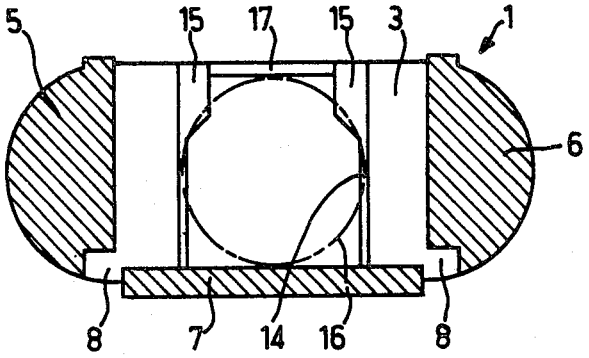
Figure 6:
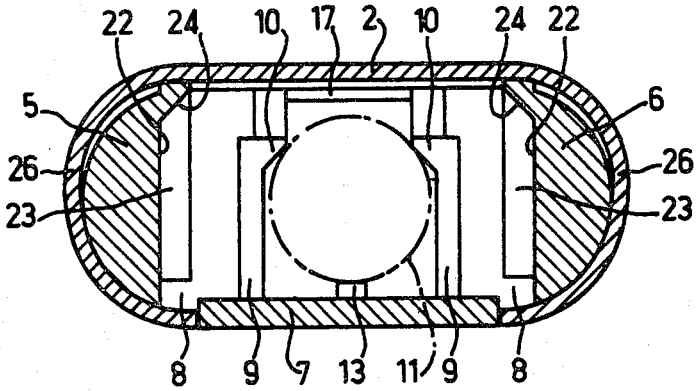

FIGS. 5 and 6 respectively are cross-sectional views along V—V and VI—VI in FIG. 2.

Figure 1:
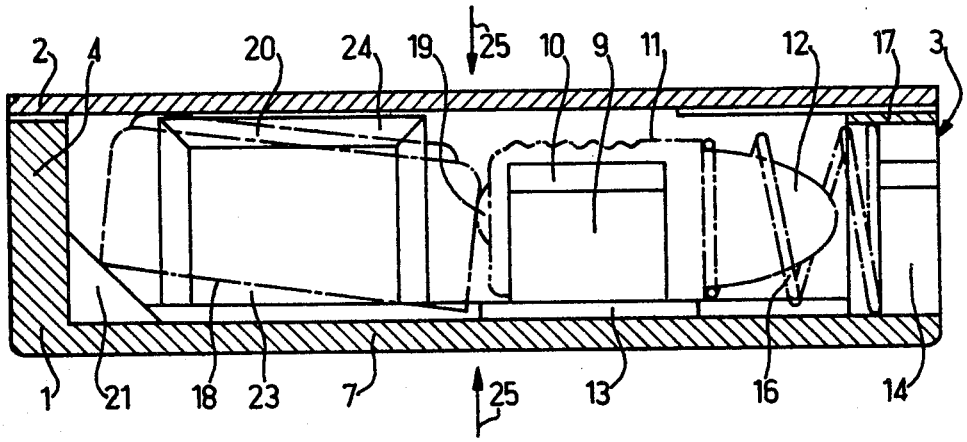
FIG. 1 is an axial section along I—I of FIG. 2.

As can be seen in FIGS. 1 and 6 in particular, the embodiment comprises a case with a flat shape made of moulded plastics material and closed by a cover 2 forming the face opposite the flat bottom of the case 1.

The case 1 comprises two end walls, respectively 3 and 4, and two side walls 5 and 6 and also a bottom wall 7. In addition, characteristically two longitudinal slits 8 are provided, preferably parallel, separating the side portions 5 and 6 from the bottom wall 7 in such a way that this bottom wall can be deformed by bending under the effect of outside pressure. These slits 8 may remain as moulded as shown in FIG. 5.

Two as-moulded parts 9 are provided on this bottom wall 7 and on the inside of the case and each comprises an end 10 which protrudes inwards to house and restrain the socket 11 of the electric bulb 12. This can be installed by simple elastic snap fit and can then slide axially inside this housing. Between the two parts 9 there is also preferably provided a rib 13 enabling the base 11 of the bulb 12 to be wedged on the case centre line and providing room for the spring.

Figure 4:
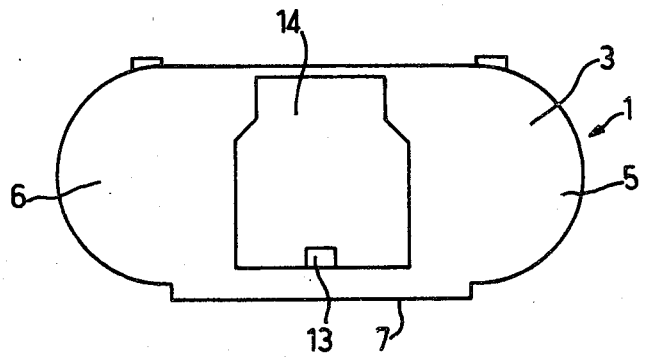
FIG. 4 is an end view along IV—IV of FIG. 2.

The end wall 3 comprises, on the bulb centre line, an opening 14 for the light to leave through, and, as is clearly shown in FIG. 4, this opening has a shape and dimensions which provide for the extraction of a core pin designed to define the internal walls opposite the parts 9 and the returns 10, and also the rib 13. Thus, after extraction of this pin parallel to the flash line, the mould can open without the necessity of any deformation of parts 9 and 10 in spite of their negative draft.

On the inner side of the case the end wall 3 has two grooves 15 which leave a margin, on either side of the opening 14, acting as the support for the first larger-diameter turn of a tapered spring 16 made of steel wire the other smaller-diameter end of which surrounds the bulb 12 and butts against the latter's socket (11).

Above the opening 14 and between the grooves 15 a partition 17 is provided which also acts as the top restraint for the large turn of the spring 16 and prevents any electrical contact between this turn and the wall 2. The under surface of this partition 17 is also formed during moulding by the above-mentioned pin.

The electric cell 18, of flat cylindrical type, takes up the room remaining in the case between the central conducting stud contact 19 of the socket 11 of the bulb 12 and the other end wall 4. The negative contact 20 of this cell 18 is oriented towards the side of the metal cover 2 and a means is provided for pushing the cell towards this cover so that it makes electrical contact with it. This means may advantageously consist of a rib 21 forming an inclined ramp, sloping at 45° for example, so converting the axial thrust of the spring 16, transmitted by the socket 11 and its centre stud 19 to the positive cell casing, into a transverse thrust.

Figure 3:
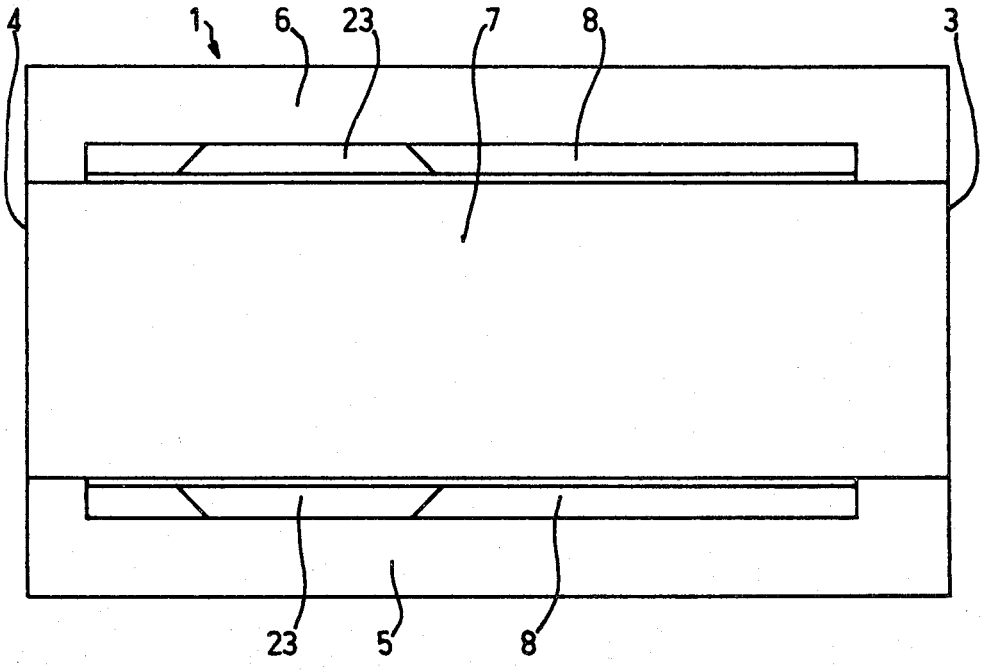
FIG. 3 is a bottom view of this case.

As shown in FIG. 6, the inner side faces 22 of the case are stepped back at the cell 18 position so as to leave room for this cell. However, it is advantageous to arrange for these recesses 23 not to open out completely at the top but to terminate in re-entrant portions 24 as shown in FIG. 6 so that the pile is inserted by force with an elastic snap fit but still continues to have axial and transverse play or clearances without being able to escape when there is no cover 2. For this purpose the recesses 23 open out into the slits 8 as shown in FIGS. 3 and 6 and the mould section which defines the recessed surfaces 22 and the negative draft surfaces 24 is fixed to the bottom section of the mould in order to be extracted perpendicularly to the flash line but through the bottom face of the case 1 in order to keep the mould simple and facilitate stripping.

When the flat case is pressed between the thumb and the finger as shown schematically by the arrows 25 in FIG. 1, the bottom wall 7 is bent towards the top of the figure until the back portion of the metal socket 11 of the bulb 12 comes into contact with the wall 2, which lights the lamp 12 provided this wall is conducting, at least on its inside surface and at least over the distance from the point of contact with the socket 11 to the point of contact with the contact 20 of the cell 18. In particular this wall 2 can advantageously consist of a metal wall, and it is obvious that, instead of bending the bottom wall 7 when lighting the lamp this conducting part could be bent just as well.

On the contrary it seemed more advantageous in this embodiment to make the metal wall 2 in the form of a sheath which also comprises side returns 26 which wrap round the case 1 and which join up with the outer surface of the bottom wall 7 of this case so as to close the slits 8 and the openings of the recesses 23 whilst improving the appearance and strength of the whole unit. Assembly and disassembly are then achieved by simply sliding part 1 inside this metal sheath, which is easy to do in spite of the small size of the unit since all the component parts (12, 16, 18) are held captive as soon as they are inserted into the case 1.

It is possible to mould the lateral parts 5 and 6 on the side of the front wall 3 in the form of locking ribs and to make openings in the returns of the metal sheath on this front end so that the lamp according to the invention can also form a key-ring holder according to French patent 2 485 345 in the applicant's name; the two functions can be provided with virtually no extra cost, either for the moulding 1 or for the sheath 2, it being necessary, consequently, only to supply the rigid key-ring which is introduced into these openings and is locked into position by the said ribs when the indicated sliding operation is performed.

I claim:

1. A miniature flashlight consisting of a case (1) of moulded plastics material closed by a cover (2) that is at least partly metallic and containing a cell (18), an electric bulb (11-12) and a pressure spring (16), the whole being of a flat shape and comprising two facing walls formed respectively by the bottom wall (7) of the case and by at least a portion of the cover (2); the cell (18) consisting of a flat cylindrical cell the casing of which is in contact with the centre contact stud (19) of the bulb and the opposite polarity contact of which is oriented towards the cover (2); the bottom wall (7) of the case (1) comprising parts (9, 10) to house and restrain the socket (11) of the bulb (12); and one at least of the said two facing walls (7 and 2) being flexible enough for compression of the whole unit between the fingers (25) to bring the socket (11) or the pile (18) contact (20) into contact with the conducting portion of the cover (2), characterized in that the pressure spring (16) is located between the bulb (12) and the light outlet opening (14) made in one end wall (3) and in that a ramp (21) is provided close to the other case (1) end wall (4) enabling the axial thrust of the spring (16), transmitted to the cell (18) by the centre contact stud (19) of the bulb (12), to be converted into a transverse thrust ensuring contact between the cell (18) conducting contact (20) and the conducting wall of the cover (2).

2. The flashlight according to claim 1, characterized in that the case (1) comprises two longitudinal slits (8) separating the bottom wall (7) from the corresponding side walls (5 and 6) of the case to permit deformation of the said bottom wall by bending.

3. The flashlight according to claim 1, characterized in that the light outlet opening (14) has its dimensions and shape determined by the projection of the inside surfaces facing the parts (9 and 10) restraining the bulb socket (11).

4. The flashlight according to claim 1, characterized in that, at the position occupied by the cell (18), the facing lateral faces (22) of the case (1) are stepped back with, on the side opposite the bottom wall, re-entrant parts (24) restraining the cell, with these surfaces (22) and there re-entrant parts (24) delimiting recesses (23) which open into the slits (8) on the side of the bottom wall (7).

5. The flashlight according to claim 1, characterized in that the cover (2) is made up of a metal sheath with returns (26) completely enveloping the case (1) except for the said deformable bottom wall (7), and which, in particular, comes and closes the slits (8) and recesses (23) opening out on the side of this wall.

6. The flashlight according to claim 5, characterized in that the said metal sheath (2) and the said case (1) respectively comprise openings and ribs enabling a key-ring holder of known type to be produced.

* * * * *